United States Patent [19]

Ikenoue et al.

[11] 4,144,072

[45] Mar. 13, 1979

[54] THERMALLY DEVELOPABLE LIGHT-SENSITIVE MATERIAL

[75] Inventors: Shinpei Ikenoue; Takao Masuda; Nobuyoshi Sekikawa, all of Asaka, Japan

[73] Assignee: Fuji Photo Film Co., Ltd., Minami-ashigara, Japan

[21] Appl. No.: 844,858

[22] Filed: Oct. 25, 1977

[30] Foreign Application Priority Data

Oct. 29, 1976 [JP] Japan ..... 51-130769

[51] Int. Cl.[2] ..... G03C 1/02; G03C 1/76

[52] U.S. Cl. ..... 96/114.1; 96/67.94 R; 96/114.6

[58] Field of Search ..... 96/114.1, 114.6, 67.94 R

[56] References Cited

U.S. PATENT DOCUMENTS

| | | | |
|---|---|---|---|
| 3,985,565 | 10/1976 | Gabrielsen et al. | 96/114.1 |
| 4,002,479 | 1/1977 | Suzuki et al. | 96/114.1 |
| 4,013,473 | 3/1977 | Willems et al. | 96/114.1 |

*Primary Examiner*—Edward C. Kimlin
*Assistant Examiner*—Alfonso T. Suro Pico
*Attorney, Agent, or Firm*—Sughrue, Rothwell, Mion, Zinn and Macpeak

[57] ABSTRACT

A thermally developable light-sensitive material containing at least (a) an organic silver salt, (b) a photocatalyst and (c) a reducing agent in a support and/or in one or more layers thereon and, additionally containing (d) at least one phthalazinone, and (e) at least one phthalimide, having improved shelf life particularly at high humidity, providing pure black tone images, and further providing a high speed upon heat development.

8 Claims, No Drawings

THERMALLY DEVELOPABLE LIGHT-SENSITIVE MATERIAL

BACKGROUND OF THE INVENTION

1. Field of the Invention

The present invention relates to a thermally developable light-sensitive material, and particularly to a thermally developable light-sensitive material which provides pure black tone images and, at the same time, whose shelf life (which means the ability of the thermally developable light-sensitive material to retain those photographic properties initially possessed even after prolonged storage, in other words, "freshness retaining property") is improved, and whose developing speed is further improved.

2. Description of the Prior Art

A variety of methods which comprise subjecting photographic materials containing light-sensitive components such as silver halide or the like to a so-called dry processing by heating to thereby obtain an image are known. Of these light-sensitive materials which can form photographic images using such a dry processing, the most promising one is, at present, a thermally developable light-sensitive material as described in U.S. Pat. Nos. 3,152,904, 3,457,075, 3,707,377 and 3,909,271, etc., in which an oxidation-reduction image forming composition comprising, as essential components, organic silver salt oxidizing agents (for example, silver behenate), photocatalysts such as a small amount of a light-sensitive silver halide and reducing agents is utilized. While the thermally developable light-sensitive material is stable at normal temperature, the organic silver salt oxidizing agent and reducing agent present in the light-sensitive layer undergo, when heated generally at temperatures of higher than about 80° C., preferably greater than 100° C. after exposure to light, an oxidation reduction reaction due to the catalytic action of the photocatalyst such as exposed silver halide which is present in proximity to the organic silver salt oxidizing agent and reducing agent to thereby form silver; whereby the exposed areas of the light-sensitive layer are rapidly darkened so that a contrast is formed between the exposed areas and the unexposed areas (background) to form an image.

In this thermally developable light-sensitive system, the photocatalyst, such as silver halide or the like, remains in the thermally developable light-sensitive material after development without stabilizing the photocatalyst to light. While such can change on exposure to light, the system exhibits the same effect as if stabilized. This is because the photocatalyst such as silver halide or the like is employed in a small amount and the major portions comprise stable white or light colored organic silver salts which are difficultly blackend by light, and therefore, the system appears white or lightly colored as a whole even though a small amount of the photocatalyst such as silver halide or the like changes color upon exposure to light, and such a slight change in color does not degrade the visual appearance.

In most cases, the image provided by the thermally developable light-sensitive material using the above described silver salt oxidizing agent is yellow brown in color. However, it is known that, by incorporating a color toning agent therein, the thermally developable light-sensitive material could be so improved as to obtain an image having a good black tone. U.S. Pat. No. 3,457,075 and the like disclose that phthalazinone can be employed alone as such a color toning agent. Where phthalazinone is used alone, however, disadvantages of a deterioration in shelf life, particularly shelf life at high humidity, are encountered. That is, where the light-sensitive material is exposed to light and developed by heating after storage thereof at high humidity e.g., 80% RH, the color tone of the images obtained becomes brown. The maximum density of the images is also reduced, and furthermore, the sensitivity thereof is also decreased. In addition, phthalazinone very easily sublimes so that, when a number of sheets of thermally developable light-sensitive materials containing phthalazinone are processed with the same processing machine, the processing machine is contaminated by the sublimed phthalazinone. In order to prevent the sublimation of phthalazinone upon heat development, Japanese Patent Application (OPI) No. 67132/75 (which corresponds to U.S. Patent Application Ser. No. 708,450 filed July 26, 1976, now U.S. Pat. No. 4,076,534) discloses phthalazinone derivatives with substituents on the condensed benzene ring thereof. Problems still exist with a thermally developable light-sensitive material using phthalazinone derivatives and the shelf life at high temperature and high humidity needs to be improved, although sublimation is not a problem in the light-sensitive material and the shelf life of the light-sensitive material with the passage of time under normal conditions is excellent. In addition, a thermally developable light-sensitive material comprising a phthalazinone derivative having a carbamoyl group at the N-position thereof as disclosed in U.S. Pat. No. 3,844,797 possesses the disadvantage that the speed of heat development is slow.

On the other hand, examples of compounds heretofore known as a color toning agent, in addition to the above described phthalazinones, include the cyclic imides such as quinalizines, pyrazolin-2-ones and succinic imides as described in U.S. Pat. No. 3,846,136; the benzoxazinediones and quinazolidinediones as described in U.S. Pat. No. 3,951,136; the N-hydroxynaphthalimides as described in U.S. Pat. No. 3,782,941; the mercapto compounds as described in U.S. Pat. Nos. 3,832,186 and 3,881,938; the phthalazinediones as described in Japanese Patent Application No. 116471/73 (which corresponds to U.S. Patent Application Ser. No. 708,450, filed July 26, 1976, now U.S. Pat. No. 4,076,534); the uracils, barbiturates, saccharin, 5-nitrosaccharin, phthalic anhydride, sulfolene, 2-mercaptobenzoxazole, 2-hydroxybenzothiazole, 2-amino-6-methylbenzothiazole, 2-amino-4-(4-biphenylyl)thiazole, imidazole, N,N'-ethylene thiourea, 1-acetyl-2-thiohydantoin as described in British Pat. No. 1,462,016; and the like. However, these known color toning agents have insufficient color toning activity, decrease shelf life or decrease the speed of heat development, which are not desirable.

In addition, the phthalimides as described in British Pat. No. 1,380,795 have the disadvantages of insufficient color toning activity, of delay in speed of heat development, of insufficient shelf life at high humidity, of deterioration of images in color tone, of decrease in maximum density, and of serious decrease in sensitivity, when such a color toning agent is used alone.

Further, U.S. Pat. No. 3,951,136 discloses that toner compounds (for example, unsubstituted phthalazinone, phthalazinone derivatives, phthalimide or phthalimide derivatives) which can ordinarily be employed can be used in combination with benzoxadindiones or quinazolidindiones. However, nothing has been stated regarding the effect of the combination.

Furthermore, U.S. Pat. No. 3,980,482 discloses a thermally developable light-sensitive material which is prepared by adding N,N,N',N'-tetramethylphthalimide as a sensitizing agent prior to halidation of organic silver salts (the procedure whereby a portion of the organic silver salts are halogenated thereby form light sensitive silver halide) and by adding phthalazinone as a color toning agent after the halidation. However, Japanese Patent Application (OPI) No. 7914/76 does not disclose the effect which would be achieved by the combined use of N,N,N',N'-tetramethylphthalimide and phthalazinone. In addition, even if N-methylphthalimide is used in combination with phthalazinone in accordance with the method as described in Japanese Patent Application (OPI) No. 7914/76, the shelf life can not be improved when compared with the use of phthalazinone alone.

As stated above, it is difficult simultaneously to achieve pure black color tone images in a thermally developable light-sensitive material, and to improve the thermally developable light-sensitive material in shelf life at high humidity, and further to improve the thermally developable light-sensitive material in speed of heat development.

SUMMARY OF THE INVENTION

Accordingly, an object of the present invention is to provide a thermally developable light-sensitive material in which shelf life is improved particularly at high humidity, and in which the color tone of the image is pure black and further in which a high speed of heat development is achieved.

Accordingly, the present invention provides a thermally developable light-sensitive material containing at least (a) an organic silver salt,
(b) a photocatalyst, and
(c) a reducing agent, in a support and/or in one or more layers thereon, and the thermally developable light-sensitive material additionally containing (d) at least one phthalazinone and
(e) at least one phthalimide in the one or more layers, in an over coated layer on the one or more layers, in a subbing layer betwen the support and the one or more layers and/or in the support.

DETAILED DESCRIPTION OF THE INVENTION

In the present invention, it is difficult to set forth unequivocally the amounts of component (d) and (e) since the amounts thereof used will vary depending upon kinds of component (a), the organic silver salt, or component (c), the reducing agent; but, in general, component (d) is used in an amount of about 0.1 to about 2 mols per mol of the organic silver salt of component (a), preferably about 0.3 mol to about 1 mol. Component (e) is used in an amount of from about 0.1 to about 4 mols per mol of component (d), preferably about 0.5 to about 2 mols. If the amount of component (d) is too small, the images do not have a pure black color tone and the speed of heat development is slow. On the other hand, if the amount of component (d) is too large, fog, which is caused by heat development, is increased. Further, if the amount of component (e) is too small, the shelf life is not sufficient at high humidity (e.g., more than 70% RH). Further, if the amount of the component (e) exceeds the optimal amount thereof, the improvement of the light-sensitive material in efficiency corresponded to the increase of the amount of component (e) is not recognized.

Suitable phthalazinones which can be used as component (d) in the present invention can be represented by the general formula (I):

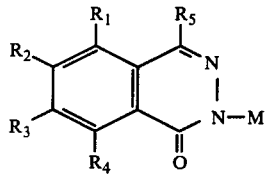

(I)

wherein $R_1$, $R_2$, $R_3$, $R_4$ and $R_5$, which may be the same or different, each represents a hydrogen atom, a halogen atom, a hydroxy group, a nitro group, an $—NH_2$ group and a carbon-containing substituent having 1 to 20 carbon atoms in which the carbon-containing substituent may also contain an oxygen atom, a nitrogen atom, a sulfur atom, a halogen atom or the like; and M represents a hydrogen atom, a monovalent metal atom, a hydroxyalkyl group having 1 to 5 carbon atoms, and a carbamoyl group containing a carbon-containing substituent having 1 to 18 carbon atoms.

In the general formula (I) described above, examples of suitable halogen atoms for $R_1$, $R_2$, $R_3$, $R_4$ and $R_5$ include, for example, a chlorine atom, a bromine atom and an iodine atom.

Examples of suitable carbon-containing substituents for $R_1$, $R_2$, $R_3$, $R_4$ and $R_5$ include an alkyl group having 1 to 4 carbon atoms such as a methyl group, an ethyl group, a propyl group, and the like; a cycloalkyl group having 5 to 6 carbon atoms; a haloalkyl group having 1 to 4 carbon atoms such as a chloromethyl group, a bromoethyl group, a chloropropyl group, and the like; a hydroxyalkyl group having 1 to 4 carbon atoms such as a hydroxymethyl group, a $\gamma$-hydroxypropyl group, etc.; an alkoxy group having 1 to 4 carbon atoms such as a methoxy group, an ethoxy group, a butoxy group, etc.; an aryl group such as a phenyl group, a naphthyl group, etc.; an aryl group which is substituted with an alkyl group having 1 to 4 carbon atoms, such as a tolyl group, etc.; an aryl group which is substituted with a halogen atom, such as a chlorophenyl group, a bromophenyl group, etc.; an aralkyl group having 7 to 12 carbon atoms, such as a benzyl group, a phenethyl group, a p-methoxybenzyl group, etc.; an acyl group having 2 to 4 carbon atoms, such as an acetyl group, a propionyl group, etc.; an alkenyl group having 3 to 6 carbon atoms, such as an allyl group, etc.; an alkyl group having 1 to 4 carbon atoms and substituted with a morpholino group, such as a morpholinomethyl group, a morpholinoethyl group, a morpholinopropyl group, a morpholinobutyl group, etc.; a 2-substituted vinyl group such as a $\beta$-styryl group, a 2-(3-pyridyl)-vinylidene group, a a 2-(2-pyridyl)vinylidene group, etc.; an aminoalkyl group having 1 to 4 carbon atoms such as an aminomethyl group, an aminoethyl group, an aminobutyl group, etc.; an amino group which is substituted with an alkyl group having 1 to 4 carbon atoms, such as a dimethylamino group, a diethylamino group, etc.; an aminoalkyl group having 1 to 4 carbon atoms and which is substituted with an alkyl group having 1 to 4 carbon atoms, such as a dimethylaminomethyl group, a diethylaminomethyl group, etc.; and the like.

Compounds wherein $R_1$, $R_2$, $R_3$ and $R_4$ are a hydrogen atom are particularly preferred since the speed of heat development is rapid.

In the general formula (I) described above, examples of suitable monovalent metal atoms for M include a lithium atom, a sodium atom, a potassium atom, a silver atom, etc. Examples of hydroxyalkyl groups having 1 to 5 carbon atoms for M are hydroxymethyl group, a $\beta$-hydroxyethyl group, a $\gamma$-hydroxypropyl group, and the like. Of these, a hydroxymethyl group is preferred. The carbamoyl group with a carbon-containing substituent having 1 to 18 carbon atoms for M is a group which is specifically represented by the formula:

$$-\underset{\underset{O}{\|}}{C}-NHR_6$$

wherein $R_6$ is a carbon-containing substituent having 1 to 18 carbon atoms which may also contain an oxygen atom, a nitrogen atom, a sulfur atom or a halogen atom.

Preferred examples of carbon-containing substituents for $R_6$ include an alkyl group having 1 to 18 carbon atoms such as a methyl group, an ethyl group, a propyl group, a hexyl group, a dodecyl group, an octadecyl group, etc.; a cycloalkyl group having 5 to 12 carbon atoms such as a cyclohexyl group, a cyclopentyl group, etc.; an alkyl group having 1 to 12 carbon atoms which is substituted with an alkoxy group having 1 to 4 carbon atoms such as a methoxyethyl group, an ethoxymethyl group, etc.; an alkenyl group having 3 to 6 carbon atoms such as an allyl group etc.; an aryl group such as a phenyl group, a naphthyl group, etc.; an aryl group which is substituted with a carbonyl group such as a benzoyl group, etc.; an aryl group which is substituted with an alkyl group having 1 to 4 carbon atoms such as a tolyl group, a p-ethylphenyl group, etc.; an aryl group which is substituted with an alkoxy group having 1 to 4 carbon atoms such as a methoxyphenyl group, etc.; an aryl group which is substituted with a halogen atom such as a p-chlorophenyl group, a 1-bromo-2-naphthyl group, etc.; an aryl group which is substituted with an aryl group having 6 to 10 carbon atoms such as a biphenyl group, etc.; and the like.

Compounds wherein M is a hydrogen atom or a monovalent metal atom are particularly preferred because the speed of heat development is rapid.

Preferred specific examples of phthalazinones for component (d) include the following compounds.

(1) Phthalazinone
(2) 4-Methylphthalazinone
(3) 4-Phenylphthalazinone
(4) 4-(1-Naphthyl)phthalazinone
(5) 4-(2-Naphthyl)phthalazinone
(6) 4-Hydroxymethylphthalazinone
(7) 4-Chlorophthalazinone
(8) 4-(p-Chlorophenyl)phthalazinone
(9) 4-(p-Pyridino)phthalazinone
(10) 4-Methoxyphthalazinone
(11) 4-$\beta$-Styrylphthalazinone
(12) 4-Dimethylaminomethylphthalazinone
(13) 4-Morpholinomethylphthalazinone
(14) 4-(p-Methoxybenzyl)phthalazinone
(15) 4-(Benzylidenehydrazino)phthalazinone
(16) 4-(p-Dimethylaminophenyl)phthalazinone
(17) 4-Benzylphthalazinone
(18) 6-Chlorophthalazinone
(19) 5,7-Dimethoxyphthalazinone
(20) 8-Methylphthalazinone
(21) 6-Bromophthalazinone
(22) 8-t-Butylphthalazinone
(23) 5-Nitrophthalazinone
(24) 8-Aminophthalazinone
(25) 8-Hydroxyphthalazinone
(26) Phthalazinone sodium salt
(27) Phthalazinone potassium salt
(28) Phthalazinone lithium salt (29)

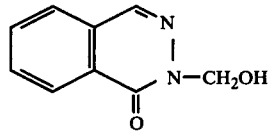

(30)

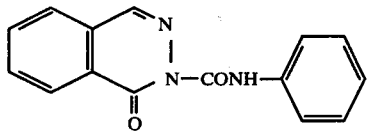

(31)

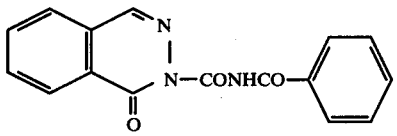

(32)

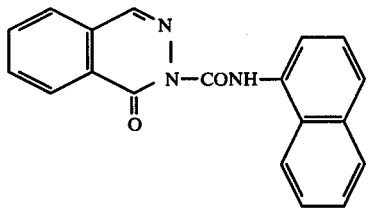

(33)

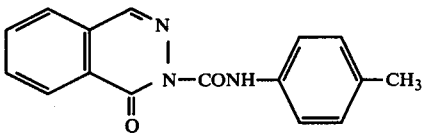

(34)

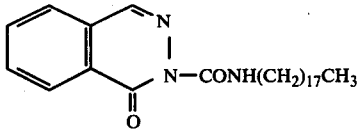

(35)

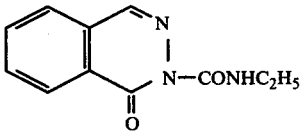

(36)

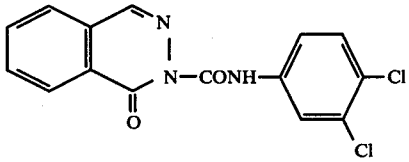

(37)

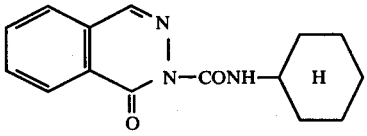

Suitable phthalimides which can be employed as component (e) in the present invention, are preferably represented by the general formula (II)

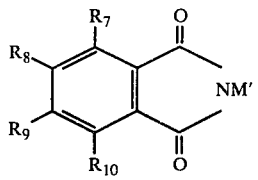

(II)

wherein $R_7$, $R_8$, $R_9$ and $R_{10}$, which may be the same or different, each represents a hydrogen atom, a halogen atom, a hydroxy group, a nitro group, an amino group, and a carbon-containing substituent having 1 to 20 carbon atoms, in which the carbon-containing substituent may also contain an oxygen atom, a nitrogen atom, a sulfur atom, a halogen atom, or the like; further, $R_7$ and $R_8$, $R_8$ and $R_9$, or $R_9$ and $R_{10}$, may combine together, and represent an aromatic ring; and M' represents a hydrogen atom and a monovalent metal atom.

Examples of suitable halogen atoms for $R_7$, $R_8$, $R_9$ and $R_{10}$ include a fluorine atom, a chlorine atom a bromine atom and an iodine atom.

Examples of suitable carbon-containing substituents for $R_7$, $R_8$, $R_9$ and $R_{10}$ include an alkyl group having 1 to 6 carbon atoms such as a methyl group, an ethyl group, a propyl group, a butyl group, etc.; a haloalkyl group having 1 to 6 carbon atoms such as a chloromethyl group, a $\beta$-bromoethyl group, etc.; a hydroxyalkyl group having 1 to 6 carbon atoms such as a hydroxymethyl group, a $\gamma$-hydroxypropyl group, etc.; an alkoxy group having 1 to 6 carbon atoms such as a methoxy group, an ethoxy group, a butoxy group, etc.; an aralkoxy group having 7 to 12 carbon atoms such as a benzyloxy group, etc.; a cycloalkyl group having 5 to 12 carbon atoms such as a cyclopentyl group, a cyclohexyl group, etc.; a cycloalkoxy group having 5 to 12 carbon atoms such as a cyclopentoxy group, a cyclohexyloxy group, etc.; an amino group which is substituted with an alkyl group having 1 to 4 carbon atoms such as a dimethylamino group, a diethylamino group, etc.; an acyl group having 2 to 6 carbon atoms such as an acetyl group, a propionyl group, etc.; an alkenyl group having 3 to 6 carbon atoms such as an allyl group, etc.; an aryl group such as a phenyl group, a naphthyl group, etc.; an aryl group which is substituted with an alkyl group having 1 to 6 carbon atoms, such as a tolyl group, etc.; an aryl group which is substituted with a halogen atom, such as a chlorophenyl group, a bromophenyl group, etc.; an aralkyl group having 7 to 12 carbon atoms, such as a benzyl group, a phenethyl group, a p-methoxybenzyl group, etc.; and the like.

Phthalimides wherein at least one of $R_7$, $R_8$, $R_9$ and $R_{10}$ is a halogen atom are particularly preferred in the present invention because fog is reduced.

Preferred examples of monovalent metal atoms for M' include a lithium atom, a sodium atom, potassium atom, a rubidium atom, a cesium atom, and the like.

A benzene ring and a naphthalene ring are preferred as the aromatic ring which is formed by the combination of $R_7$ and $R_8$, $R_8$ and $R_9$, or $R_9$ and $R_{10}$.

Preferred specific examples of component (e) are described below:

(1) Phthalimide
(2) 3-Methylphthalimide
(3) 3-Methoxyphthalimide
(4) 4-Methylphthalimide
(5) 4-t-Butylphthalimide
(6) 4-Hydroxyphthalimide
(7) 4-Methoxyphthalimide
(8) 4-Ethoxyphthalimide
(9) 4-Propoxyphthalimide
(10) 4-n-Butoxyphthalimide
(11) 4-Methoxy-5-methylphthalimide
(12) 4-Cyclohexylphthalimide
(13) 4-Cyclopentoxyphthalimide
(14) 4,5-Dimethylphthalimide
(15) 4-Benzyloxyphthalimide
(16) 4-Styrylphthalimide
(17) 4-p-Methoxystyrylphthalimide
(18) 3-Allylphthalimide
(19) 3,4-Dimethoxyphthalimide
(20) 3-Benzyloxyphthalimide
(21) 3-chlorophthalimide
(22) 4-Bromophthalimide
(23) 3-Bromophthalimide
(24) 3-Vinylphthalimide
(25) 4-Chlorophthalimide
(26) 3-Dimethylaminophthalimide
(27) 4-Dimethylaminophthalimide
(28) 3-Nitrophthalimide
(29) 4-Nitrophthalimide
(30) 3-Phenylphthalimide
(31) 4-Phenylphthalimide
(32) 3,4,5,6-Tetrabromophthalimide
(33) 3,4,5,6-Tetrachlorophthalimide
(34) 3,4,5,6-Tetrafluorophthalimide
(35) 3,4,5,6-Tetraethylphthalimide
(36) 3,4,5,6-Tetramethylphthalimide
(37) 3,6-Dibromophthalimide
(38) 3,6-Dichlorophthalimide
(39) 3,6-Dimethoxyphthalimide
(40) 3,4-Dimethylphthalimide
(41) 3,6-Dimethylphthalimide
(42) 4,5-Dimethylphthalimide
(43) 4-Phenoxyphthalimide
(44) 3-Propylphthalimide
(45) 4-Trifluoromethylphthalimide
(46) 4-Vinylphthalimide
(47) 3-Acetylphthalimide
(48) 3-Benzylphthalimide
(49) 3-Hydroxymethylphthalimide
(50) Phthalimide sodium salt
(51) Phthalimide potassium salt
(52) Phthalimide lithium salt.

Components (a), (b) and (c) can be present in the same layer or in different layers on the support. Further components (a), (b) and (c) may be wholly or partly incorporated in the support as well. For instance, when a paper, a non-woven fabric and the like are used as the support, components (a), (b) and (c) can wholly or partly migrate into the support.

Both components (d) and (e) described above can be incorporated in at least one of a layer containing components (a), (b) and/or (c) (this layer is hereafter referred to as the light-sensitive layer), an over coated layer on the light-sensitive layer, a subbing layer between the support surface and the light-sensitive layer, and the support.

In addition, where components (a), (b) and (c) are wholly or partly incorporated in the support, components (d) and (e) can be incorporated into the support or into a layer on the support.

In accordance with the present invention, it is particularly preferred for components (a), (b), (c), (d) and (e) to be present in the same layer on the support.

Component (d) and component (e) can be present in different layers, if desired, but it is preferred that component (d) and component (e) be present in the same layer.

In the present invention, it is preferred for component (d) and component (e) to be introduced into the thermally developable light-sensitive material during the preparation of the material. However, these components can also be introduced by coating a solution containing component (d) and component (e) on the thermally developable light-sensitive material after the preparation thereof.

It is preferred for component (d) and component (e) to be co-present in the light-sensitive layer since the procedures for preparing the thermally developable light-sensitive material are simple and the effects of the present invention are best achieved. In this case, component (d) and component (e) are incorporated in a composition in which at least component (a) and component (b) are present, of components (a), (b) and (c) and the like which form a coating composition for the light-sensitive layer. That is, when a light-sensitive silver halide which was previously prepared as component (b) is used, component (d) and component (e) are incorporated in the composition, after mixing the light-sensitive silver halide and component (a); further, when a light-sensitive silver halide forming component, hereinafter described, is used as component (b), component (d) and component (e) are incorporated in the composition after mixing component (a) and the light-sensitive silver halide forming component. Further, component (d) and component (e) can also be incorporated prior to the addition of a reducing agent component (c), and vice versa. This can be achieved by adding, to the coating composition for the light-sensitive layer which contains component (a) and component (b), component (d) and component (e) in the form of a finely divided solid thereof, or in the form of a solution or dispersion thereof in an appropriate solvent (for example, water, methanol, ethanol, acetone, methyl ethyl ketone, cyclohexane, dioxane, toluene, benzene, ethyl acetate, tricresyl phosphate, methyl Cellosolve, dimethylformamide, and the like).

The present invention achieves the desired effects by using component (d) and component (e) described above in a thermally developable light-sensitive material comprising an oxidation-reduction image forming composition containing at least (a) an organic silver salt, (b) a photocatalyst and (c) a reducing agent.

The organic silver salt which is employed as component (a) in the present invention is a colorless, white or lightly colored silver salt, which reacts with a reducing agent (c) in the presence of a photocatalyst (b) such as exposed silver halide or the like, when heated at temperatures of about 80° C. or higher, preferably 100° C. or higher to thereby produce silver (image). Such organic silver salts are generally silver salts of organic compounds having an imino group, a mercapto group, a thione group or a carboxyl group. Specific examples of these silver salts include the following:

(I) Silver salts of organic compounds having an imino group as described in Japanese Patent Application (OPI) No. 91214/74 and U.S. Pat. Nos. 3,152,904, 3,457,075, 3,933,507 and 3,951,136, etc. (for example, silver saccharin, silver benzotriazole, silver N-phthalimide, etc.);

(II) Silver salts of organic compounds having a mercapto group or a thione group as described in U.S. Pat. No. 3,785,830 and Japanese Patent Application (OPI) No. 10039/74, etc. (for example, silver 2-mercaptobenzoxazole, silver 3-(2-carboxyethyl)-1-phenyl-1,3,4-triazolin-2-thione, etc.);

(III) Silver salts of organic compounds having a carboxyl group as are described in U.S. Pat. Nos. 3,457,075, 3,330,663 3,3667,958 and 3,589,901, Japanese Patent Publication No. 18808/74, U.S. Pat. Nos. 3,846,136, 3,816,132, 3,773,512 3,770,448 and 3,928,686, etc. (for example, silver salts of aliphatic carboxylic acids such as silver caprylate, silver laurate, silver myristate, silver palmitate, silver stearate, silver behenate, silver maleate, silver fumarate, silver tartarate, silver furoate, silver linolate, silver oleate, silver hydroxystearate, silver adipate, silver sebacate, silver succinate, silver acetate, silver butyrate, silver camphorate, etc.; silver salts of aromatic carboxylic acids, such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, silver gallate, silver tannate, silver phthalate, silver terephthalate, silver salicylate, silver phenylacetate, silver pyromellate, silver salt of 4'-n-octadecyloxydiphenyl-4-carboxylic acid, etc.);

(IV) Silver sulfonates (for example, silver ethanesulfonate, silver 1-propanesulfonate, etc.), silver sulfinates (for example, silver p-toluenesulfinate, etc.), and others such as silver salts of tetraazaindenes as described in British Pat. No. 1,230,642 and Japanese Patent Application (OPI) Nos. 89720/73, etc.

Of these organic silver salts, in the case of using a silver halide (or a silver-dye light-sensitive complex as hereinafter described) as a photocatalyst, organic silver salts which are relatively stable to light are suitable, and particularly preferred organic silver salts are silver salts of aliphatic acids having 10 or more carbon atoms (of these, silver salts of aliphatic acids having 16 to 41 carbon atoms, for example, silver salts of aliphatic acids having an even number of carbon atoms such as silver palmitate, silver stearate, silver behenate, etc., and other silver salts of aliphatic acids having an odd number of carbon atoms such as $CH_3(CH_2)_{21}COOAg$, $CH_3(CH_2)_{27}COOAg$, etc. are more preferred).

The amount of the organic silver salts as component (a) generally used is about 0.1 to about 4 g, as silver, per $m^2$ of the support (hereinafter described), preferably about 0.2 to about 2.5 g per $m^2$. If the amount is less than about 0.1 $g/m^2$, the image density is too low; if the amount is above about 4 $g/m^2$, the amount of silver used is increased without any additional increase in image density, and thus the production cost is increased.

A variety of methods are known in order to prepare such organic silver salts, and are described in detail in U.S. Pat. Nos. 3,457,075, 3,458,544, 3,700,458 and 3,839,049, British Pat. Nos. 1,405,867 and 1,173,426, Japanese Patent Application (OPI) No. 22431/76, Japanese Patent Application No. 45997/75, etc. The organic silver salts used as component (a) in the present invention can be prepared using any of these methods.

The particle size of the organic silver salts which are employed in accordance with the present invention ranges from about 10 microns to about 0.01 micron as a length, preferably from about 5 microns to about 0.1 micron.

Component (b) of the present invention is one which renders the thermally developable light-sensitive material light sensitive and functions as a catalyst for the oxidation-reduction image forming reaction between component (a) and component (c).

Preferably, the photocatalyst, or component (b) which is used in accordance with the present invention is a light-sensitive silver halide such as silver chloride, silver bromide, silver iodide, silver chlorobromoiodide, silver chlorobromide, silver chloroiodide, silver iodobromide or a mixture thereof. The amount of the light-sensitive silver halide used ranges from about 0.001 mol to about 0.5 mol per mol of the organic silver salt (a), preferably from about 0.01 mol to about 0.3 mol. A preferred particle size of the silver halide ranges from about 2 microns to about 0.01 micron, preferably from about 0.5 micron to about 0.01 micron. The light-sensitive silver halide can be prepared as desired, using conventional methods employed in the photographic field, such as the single jet method, the double jet method, or the like. For example, a Lippman emulsion, an emulsion prepared using an ammonia method, a thiocyanate- or thioether-ripened emulsion, and the like can be employed. The light-sensitive silver halide thus previously prepared is mixed with an oxidation-reduction composition comprising an organic silver salt (a) and a reducing agent (c) to form an oxidation-reduction image forming composition. This is described in U.S. Pat. No. 3,152,904.

In order to facilitate sufficient contact of the silver halide as component (b) and the organic silver salt as component (a), a variety of methods can be used. One method is a technique in which a surface active agent is present in the system, examples of which are described in U.S. Pat. No. 3,761,273, Japanese Patent Application (OPI) Nos. 32926/75 and 32928/75. An alternative method is a method which comprises mixing a silver halide which was prepared in a polymer, with an organic silver salt, which is described in, for example, U.S. Pat. Nos. 3,706,565, 3,706,564 and 3,713,833 and British Pat. No. 1,354,186, etc. A further alternative method is a method which comprises decomposing silver halide emulsion enzymatically and then mixing the product with an organic silver salt, as described in British Pat. No. 1,354,186. The silver halide which is employed in accordance with the present invention can also be prepared almost simultaneously with the formation of the organic silver salt, for example, as described in Japanese Patent Application (OPI) No. 17216/75.

As a further alternative method, a component which is capable of forming a light-sensitive silver halide (described hereinafter) can be reacted with a solution or dispersion of the organic silver salt which was previously prepared. Thus, the light-sensitive silver halide can also be formed at a part of the organic silver salt (which corresponds to the halidation method described hereinbefore). The thus-formed silver halide is in effective contact with the organic silver salt and thereby exhibits preferred activity, as described in U.S. Pat. No. 3,457,075. By adding a reducing agent thereto subsequently, an oxidation-reduction image forming composition is produced.

The term "a component which is capable of forming a light-sensitive silver halide" as used herein refers to a compound which reacts with the organic silver salt as component (a) to thereby form silver halide as component (b). The following simple test can be used to determine whether a compound can be effectively used. That is, the silver halide forming component is reacted with the organic silver salt, and if necessary, after heating, an examination of whether or not a diffraction peak specific to silver halide using an X-ray diffraction method is made.

The conditions under which silver halide is formed are as follows: the reaction temperature ranges from about −80° C. to about 100° C., preferably about −20° C. to about 90° C. The reaction time ranges from about 0.01 second to about 150 hours, preferably from about 0.1 second to about 72 hours. The reaction pressure ranges from about $10^{-2}$ mmHg to about 300 atms, preferably at atmospheric pressure.

Examples of components which are capable of forming light-sensitive silver halide are (1) inorganic halides, (2) halogen containing metal complexes, (3) onium halides, (4) halogenated hydrocarbons, (5) N-halo compounds, and (6) other halogen containing compounds; specific examples of which are described in detail in U.S. Pat. Nos. 3,457,075, 4,003,749 and 4,003,759, Japanese Patent Application (OPI) Nos. 115027/75 and 78316/75 (these corresponding to U.S. Patent Application Ser. No. 522,963 filed Nov. 11, 1974). Specific examples, in part, include (1) inorganic halides such as NaBr, LiBr, $HgBr_2$, $CaBr_2$, $AuCl_4$; (2) halogen containing metal complexes such as $K_2PtCl_6$, $K_2PtBr_6$, $HAuCl_4$, $(NH_4)_2IrCl_6$, $(NH_4)_3IrCl_6$, $(NH_4)_2RuCl_6$, $(NH_4)_3RhCl_6$, $(NH_4)_3RhBr_6$; (3) onium halides such as trimethylphenylammonium bromide, cetylethyldimethylammonium bromide, trimethylbenzylammonium bromide, trimethylbenzylammonium bromide, tetraethylphosphonium bromide, trimethylsulfonium iodide; (4) halogenated hydrocarbons such as iodoform, bromoform, carbon tetrachloride, 2-bromo-2-methylpropane; (5) N-halo compounds such as N-chlorosuccinimide, N-bromosuccinimide, N-bromophthalimide, N-bromoacetamide, N-iodosuccinimide, N-bromophthalazone, N-bromoxazoline, N-chlorophthalazone, N-bromoacetanilide, N,N-dibromobenzene sulfonamide, N-bromo-N-methylbenzene sulfonamide, 1,3-dibromo-4,4,-dimethylhydantoin, trichloroisocyanuric acid; (6) halogen-containing compounds such as triphenylmethyl chloride, triphenylmethyl bromide, 2-bromobutyric acid, 2-bromoethanol, benzophenone dichloride, triphenyl bromide; and the like.

The light-sensitive silver halide forming components can be employed individually or as a combination of two or more thereof. The amount of the silver halide forming component used ranges from about 0.001 mol to about 0.5 mol, per mol of the organic silver salt component (a), preferably from about 0.01 mol to about 0.3 mol. If the amount is less than about 0.001 mol described above, the sensitivity is poor; if the amount exceeds about 0.5 mol, change in color (undesired coloration in the background areas which is caused when the processed light-sensitive material is allowed to stand in normal room illumination) increases.

Regardless of the preparation method used, the silver halide formed can be sensitized by, for example, a sulfur containing compound, a gold compound, a platinum compound, a palladium compound, a silver compound, a tin compound, etc., or a combination thereof; e.g., as described in, for example, Japanese Patent Application Nos. 115386/74, 122902/74, 143178/74, 13074/75, 45646/75 and 81181/75.

A similar improvement in photographic properties can be achieved using a method, for example, which comprises forming silver halide in the presence of a part of the binder, recovering the silver salt by means of centrifugal separation and re-dispersing the silver salt again in the remaining binder, that is, by employing a settling method used in gelatin-silver halide emulsion techniques. The photographic properties can also be modified, upon re-dispersion, by the presence of nitric acid, ferrocyanides, thiocyanates, thiosulfates, benzotriazole, tetraazaindenes, mercapto compounds, thione compounds, iodides, heavy metal salts such as rhodium salts, etc., or the like.

In lieu of silver halide, other photocatalysts can also be used as component (b). For example, a light-sensitive complex of silver and a dye can also be employed as a photocatalyst as described in Japanese Patent Publication No. 25498/74, U.S. Patent 3,933,507 and Japanese Patent Application (OPI) No. 4728/71. Further, as described in Japanese Patent Application (OPI) No. 8522/75, a highly sensitive organic silver salt and a low light-sensitive organic silver salt can also be used in combination, as the organic silver salt. In addition thereto, metal diazosulfonates, and sulfinates as described in U.S. Pat. No. 3,152,904 can also be used as a photocatalyst. Further, photoconductive materials such as zinc oxide, titanium oxide, or the like can also be used.

In order to obtain a highly sensitive thermally developable light-sensitive material, however, it is preferred for silver halide or a silver halide forming component to be used as component (b).

Certain optically sensitizing dyes which are said to be effective for gelatin-silver halide emulsions also provide sensitizing effects on the thermally developable light-sensitive material in accordance with the present invention. Effective optical sensitizing dyes are cyanine, merocyanine, rhodacyanine, complex (trinuclear or tetranuclear) cyanine or -merocyanine, holopolar cyanine, styryl, hemicyanine, oxonol, hemioxonol, xanthene type dyes, and the like. More preferred cyanine dyes are those having a basic nucleus such as a thiazoline nucleus, an oxazoline nucleus, a pyroline nucleus, a pyridine nucleus, an oxazole nucleus, a thiazole nucleus, a selenazole nucleus, an imidazole nucleus, etc. In particular, cyanine dyes having an amino group or a carboxyl group are preferred. The merocyanine dyes can further possess, in addition to the basic nucleus as described above, for example, an acidic nucleus such as a thiohydantoin nucleus, a rhodanine nucleus, an oxazolidinedione nucleus, a thiazolidinedione nucleus, a barbituric acid nucleus, a thiazolinone nucleus, a malononitrile nucleus, a purazolone nucleus, etc. Merocyanine dyes having an imino group or a carboxyl group are particularly effective.

Specific examples of sensitizing dyes which are particularly effective in the thermally developable light-sensitive material in accordance with the present invention are merocyanine dyes having a rhodanine nucleus, a thiohydantoin nucleus or a 2-thio-2,4-oxazolidinedione nucleus, etc., as described in U.S. Pat. No. 3,761,279, Japanese Patent Application (OPI) Nos. 105127/75 and 104637/75.

In addition, trinuclear merocyanine dyes as described in U.S. Pat. No. 3,719,495; sensitizing dyes mainly for silver iodide as is described in Japanese Patent Application (OPI) No. 17719/74, styryl quinoline type dyes as described in British Pat. No. 1,409,009, rhodacyanine dyes as described in U.S. Pat. No. 3,877,943, acidic dyes, for example, such as 2′,7′-dichlorofluoresceine, as described in U.S. Pat. Nos. 3,870,523 and 3,909,271, and British Pat. No. 1,417,382, merocyanine dyes as are described in Japanese Patent Application (OPI) No. 27924/76 and the like; can also be used in the present invention.

The amount of these dyes employed ranges from about $10^{-4}$ mol to about 1 mol per mol of component (b), the silver halide or the silver halide forming component.

Component (c), or the reducing agent, which is employed in accordance with the present invention is preferably a compound capable of reducing the organic silver salt [component (a)] in the presence of a photocatalyst [component (b)] such as the exposed silver halide or the like upon heating to form a silver image. The reducing agent which is actually employed, is determined by the kind and efficiency of the organic silver salt used.

Preferred reducing agents are mono-, bis-, tris- or tetrakis-phenols, mono- or bis-naphthols, di- or polyhydroxynaphthalenes, di- or polyhydroxybenzenes, hydroxymonoethers, ascorbic acids, 3-pyrazolidones, pyrazolines, pyrazolones, reducing saccharides, phenylenediamines, hydroxylamines, reductones, hydroxamic acids, hydrazides, amidoximes, N-hydroxyureas, and the like. Specific examples of these reducing agents are described in detail in Japanese Patent Application (OPI) No. 22431/76, U.S. Pat. Nos. 3,615,533, 3,679,426, 3,672,904, 3,751,252, 3,751,255, 3,782,949, 3,801,321, 3,794,488 and 3,893,863, Belgian Pat. No. 786,086, U.S. Pat. Nos. 3,770,448, 3,819,382, 3,773,512, 3,928,686, 3,827,889, 3,839,048 and 3,887,378, and Japanese Patent Application (OPI) Nos. 15541/75, 36143/75, 36110/75, 116023/75, 147711/75, and 23721/76 Japanese Patent Application Nos. 105290/74 and 12366/74.

Of these compounds, polyphenols, sulfonamide phenols and naphthols are particularly preferred.

Preferred specific examples of polyphenols include 2,4-dialkyl substituted o-bisphenols, 2,6-dialkyl substituted p-bisphenols and mixtures thereof. For example, typical polyphenols are exemplified by 1,1-bis(2-hydroxy-3,5-dimethylphenyl)-3,5,5-trimethylhexane; 1,1-bis(2-hydroxy-3-t-butyl-5-methylphenyl)methane; 1,1-bis(2-hydroxy-3-t-butyl-5-ethylphenyl)methane; 1,1-bis(2-hydroxy-3,5-di-t-butylphenyl)methane; 2,6-methylenebis(2-hydroxy-3-t-butyl-5-methylphenyl)-4-methylphenol; 6,6′-benzylidene-bis(2,4-di-t-butylphenol); 6,6′-benzylidene-bis(2-t-butyl-4-methylphenol); 6,6′-benzylidene-bis(2,4-dimethylphenol); 1,1-bis(2-hydroxy-3,5-dimethylphenyl)-2-methylpropane; 1,1,5,5-tetrakis(2-hydroxy-3,5-dimethylphenyl)-2,4-ethylpentane; 2,2-bis(4-hydroxy-3,5-dimethylphenyl)-propane; 2,2-bis(4-hydroxy-3-methyl-5-t-butylphenyl)-propane;. 2,2-bis(4-hydroxy-3,5-di-t-butylphenyl)propane; and the like.

Preferred specific examples of naphthols include 2,2′-dihydroxy-1,1′-binaphthyl; 6,6′-dibromo-2,2′-dihydroxy-1,1′-binaphthyl; 6,6′-dinitro-2,2′-dihydroxy-1,1′-binaphthyl; bis(2-hydroxy-1-naphthyl)methane; 4,4′-dimethoxy-1,1′-dihydroxy-2,2′-binaphthyl; and the like.

Further, preferred specific examples of sulfonamide phenols include 4-benzenesulfonamide phenol; 2-benzenesulfonamide phenol; 2,6-dichloro-4-benzenesulfonamide phenol; etc. In addition to these specific example, detailed examples are further described in Japanese Patent Application (OPI) Nos. 22431/76, 36110/75, 116023/75, 147711/75 and 23721/76, Japanese Patent Application Nos. 10529/74 and 12636/74, Japanese Patent Application (OPI) No. 11541/75, U.S. Pat. Nos. 3,672,904 and 3,801,321.

Further where phenylenediamines are used as a reducing agent, a color image can be obtained by combined use with a phenolic or active methylenic color coupler as is described in U.S. Pat. Nos. 3,531,286 and 3,764,328. Likewise, a color image can be obtained also as disclosed in U.S. Pat. No. 3,761,270.

Of these reducing agents described above, particularly preferred are mono-, bis-, tris- or tetrakis-phenols containing an alkyl group such as a methyl group, an ethyl group, a propyl group, an isopropyl group, a butyl group, etc., for example, a 2,6-di-t-butylphenol group or an acyl group substituted at at least one of the two positions adjacent the hydroxyl-substituted position of the aromatic ring, since they are stable to light and produce less change in color.

In addition, as described in U.S. Pat. No. 3,827,889, when a compound which is photolytically decomposed or photoinactivated is used as a reducing agent, the light-sensitive material is decomposed or inactivated by light when allowed to stand in a light room and, hence, reduction no longer proceeds so that no change in color appears, which is preferred. Specific examples of photolytic reducing agents are ascorbic acid or derivatives thereof, furoin, benzoin, dihydroxyacetone, glyceraldehyde, rhodizonic acid, tetrahydroxyquinone, 4-methoxy-1-naphthol, the aromatic polysulfide compounds as described in Japanese Patent Application (OPI) No. 99719/75, and the like. As mentioned in U.S. Pat. Nos. 3,827,889 and 3,756,829, the thermally developable light-sensitive material which is prepared using such a photolytic reducing agent is imagewise exposed to light to thereby destroy the reducing agent; thus a positive image can also be obtained directly. Further, a compound which accelerates the photolytic property of the reducing agent can also be employed in combination therewith.

A suitable reducing agent is chosen depending upon the kind (efficiency) of the organic silver salt (a) used. For example, for a silver salt which is relatively difficult to reduce, such as silver benzotriazole or silver behenate, a stronger reducing agent is appropriate. For a silver salt which is relatively easily reduced, such as silver caprylate or silver laurate, a weaker reducing agent is suitable. Examples of reducing agents which are suitable for silver benzotriazole are, for example, 1-phenyl-3-yrazolidones, ascorbic acid, monocarboxylic acid esters of ascorbic acid, naphthols such as 4-methoxy-1-naphthols. For silver behenate, many reducing agents such as o-bisphenols of the bis(hydroxyphenyl)methane type, hydroquinone, and the like can be used. Further, for silver caprylate or silver laurate, substituted tetrakisphenols, o-bisphenols of the bis(hydroxyphenyl)alkane type, p-bisphenols such as substituted compounds of bisphenol A, etc., and p-phenylphenols, and the like can be suitably used. Which reducing agent can be used can be easily determined. For example, a light-sensitive material can be prepared as shown in the examples given hereinafter, and, from the photographic properties, the superiority or inferiority of the reducing agent can be examined.

The amount of the reducing agent which is employed in accordance with the present invention will vary widely depending upon the kinds of the organic silver salt (a) or the reducing agent (c) and other additives used, but, in general, a suitable amount ranges from about 0.05 mol to about 10 mols per mol of the organic silver salt (a), preferably from about 0.1 to about 3 mols.

The above described various reducing agents can be employed individually or as a combination of two or more thereof.

In order to further improve the properties of the above described thermally developable light-sensitive material of the present invention, the following methods and compounds can be applied.

A variety of methods for preventing fog due to heat can be employed for the thermally developable light-sensitive material of the present invention. One of these methods comprises using mercury compounds as are described in U.S. Pat. No. 3,589,903. Examples of preferred mercury compounds include mercury bromide, mercury iodide and mercury acetate. A second method for preventing heat fog comprises using N-halo compounds as described in Japanese Patent Application (OPI) Nos. 10724/74, 97613/74, 90118/74 and 22431/76, for example, N-halosuccinimides, N-haloacetamides, etc. As an alternative method for preventing heat fog, the compounds as described in U.S. Pat. No. 3,885,968, Japanese Patent Application (OPI) Nos. 101019/75, 116024/75, 123331/75, 134421/75, and 22431/76, and Japanese Patent Application Nos. 121631/74, 115781/74, 125037/74, 131827/74, 299/75, 28851/75 and 96155/75, for example, a lithium salt, a peroxide, a persulfide, a rhodium salt, a cobalt salt, a palladium compound, a cerium compound, an aliphatic acid or a salt thereof, a sulfinic acid or a salt thereof, a thiosulfonic acid or a salt thereof, a disulfide, a rosin, a polymer acid, and the like can be used.

Of these compounds, use of the thiosulfonic acid compounds as described in Japanese Patent Application No. 299/75 is particularly preferred. The thiosulfonic acid compounds can be represented by the formula:

$$RSO_2SM''$$

wherein R represents (1) an unsubstituted or substituted aliphatic group or (2) an unsubstituted or substituted aryl group, and M'' represents a cation other than a hydrogen ion. Preferably, R is an alkyl group having less than 22 carbon atoms, or a group in which the alkyl group is substituted with an alkoxy group having 1 to 8 carbon atoms or with an aryl group having 6 to 18 carbon atoms; an aryl group having 6 to 30 carbon atoms or a group in which the aryl group is substituted with an alkyl group having 1 to 8 carbon atoms, with an alkaryl group having 7 to 14 carbon atoms, with an aryl group having 6 to 18 carbon atoms, etc.

Specific examples of thiosulfonic acids which can be used are sodium n-octylthiosulfonate, potassium n-dodecylthiosulfonate, potassium n-dodecanethiosulfonate, sodium benzylthiosulfonte, soidum n-undecanethiosulfonte, potassium n-tetradecanethiosulfonate, lithium benzylthiosulfonate, potassium n-hexadecanethiosulfonate, potassium 2-ethoxyethylthiosulfonate, sodium benzenethiosulfonate, lithium benzenethiosulfonate, potassium benzenethiosulfonte, sodium p-toluenethiosulfonate, potassium p-methoxybenzenethiosulfonate, potassium p-ethoxybenzenethiosulfonate, potassium p-ethoxybenzenethiosulfonate, sodium 2-naphthylthiosulfonate, potassium 3-t-butylbenzenethiosulfonate, sodium 3,4-dimethylbenzenethiosulfonate, potassium 3-chlorobenzenethiosulfonate, sodium 4-nitrobenzenethiosulfonate, potassium 3-acetylbenzenethiosulfonate, etc. These thiosulfonic acid compounds can be employed individually or as a combination of two or more thereof.

The amount of the thiosulfonic acids used preferably ranges form about $10^{-5}$ to about 1 mol per mol of the organic silver salt (a), particularly preferably $6 \times 10^{-4}$ to $10^{-1}$ mol. Where the amount used is less than about $10^{-5}$ mol, the effect of preventing heat fog is not sufficient, and where more than about 1 mol is used, progress in development is prevented and the maximum density of the images obtained is low, which is not preferred.

In order to prevent a change in color after processing (the phenomenon that, after processing, the unexposed areas of the light-sensitive material gradually change color due to light when exposed to normal room illumination), a variety of conventional methods can be applied with the thermally developable light-sensitive material in accordance with the present invention.

For instance, methods which use precursors of stabilizing agents such as azolethioethers or blocked azolethiones, as described in U.S. Pat. No. 3,839,041; tetrazolythio compounds as described in U.S. Pat. No. 3,700,457; light-sensitive halogen-containing organic oxidizing agents as described in U.S. Pat. No. 3,707,377, halogen-containing compounds as described in Japanese Patent Application (OPI) No. 119624/75 and U.S. Pat. No. 3,874,946; 1-carbamoyl-2-tetrazolin-5-thiones as described in U.S. Pat. No. 3,893,859; sulfur as described in Japanese Patent Application (OPI) No. 26019/76, and the like can be employed.

Each of the components which are employed in accordance with the present invention is dispersed in at least one colloid which is used as a binder. Suitable binders are generally hydrophobic, but, can be hydrophilic. These binders can be transparent or opaque, and examples include, for instance, proteins such as gelatin, cellulose derivatives, polysaccharides such as dextran, natural materials such as gum arabic, etc., and others such as synthetic polymers. Suitable binders are described in Japanese Patent Application (OPI) No. 22431/76, but particularly preferred binders are polyvinyl butyral, polyvinyl acetate, ethyl cellulose, polymethyl methacrylate, cellulose acetate butyrate, gelatin, and polyvinyl alcohol. If desired, two or more of these binders may be used in combination. The weight ratio of the binder ranges from about 10:1 to about 1:10 to the organic silver salt, component (a), preferably about 4:1 to about 1:4.

The layers containing therein the components which are employed in the thermally developable light-sensitive material of the present invention, and other layers are coated a variety of supports which can be chosen from a wide variety of materials. The support can generally have any shape, but, since those which are flexible are preferred for handling as information recording materials, a film-like, sheet-like, roll-like or ribbon-like shape is ordinarily used. Suitable materials for the support, include a synthetic resin film, glass, wool, cotton cloth, paper, metals such as aluminum, etc. Examples of synthetic resin films include a cellulose acetate film, a polyester film, a polyethylene terephthalate film, a polyamide film, a polyimide film, a cellulose triacetate film, a polycarbonate film, etc. Examples of support papers include, in addition to ordinary paper, photographic support paper, printing paper such as coated paper or art paper, baryta paper, resin coated paper, water-proof paper, paper sized with a polysaccharide as described in Belgian Pat. No. 784,615, pigment paper containing titanium oxide or other pigments therein, a paper coated with an α-olefin polymer (for example, a polyethylene, a polypropylene, an ethylene-butene copolymer, etc.), paper pretreated with polyvinyl alcohol, etc.

The thermally developable light-sensitive material of the present invention can also have an antistatic layer, an electrically conductive layer, a vacuum evaporated metal layer, a subbing layer and a backing layer.

Further in order to enhance the transparency of the thermally developable light-sensitive layer and improve the heat resistance of the film, an over coated layer can be provided, if desired, on the light-sensitive layer, as described in Belgian Pat. No. 798,367, U.S. Pat. Nos. 3,856,526, 3,856,527 and 3,933,508, and Japanese Patent Application (OPI) No. 128726/74. A suitable layer thickness for the over coated polymer layer ranges from about 1 micron to about 20 microns. Suitable polymers for the over coated polymer layer are polyvinyl chloride, Saran (trade name for a copolymer of vinylidene chloride and vinyl acetate), polyvinyl acetate, vinyl chloride/vinyl acetate copolymers, polystyrene, methyl cellulose, ethyl cellulose, cellulose acetate butyrate, cellulose acetate, vinylidene chloride, polycarbonates, gelatin, polyvinyl alcohol, and the like. By incorporating titanium dioxide, kaolin, zinc oxide, silica, alumina, polysaccharides such as starch, etc., and the like in the over coated polymer layer, the thermally developable light-sensitive material can be written upon with stamp ink, a ball point pen, a pencil, etc.

A variety of additives which are conventionally used in gelatin-silver halide light-sensitive materials, such as a halation preventing agent, a whitening dye, a filter dye, a light absorbing material, a fluorescent whitening agent, a plasticizer, a lubricant, a surface active agent, a hardening agent, and the like can be employed in the thermally developable light-sensitive material, if desired. Further, if desired, matting agents such as calcium carbonate, starch, titanium dioxide, zinc oxide, silica, dextrin, barium sulfate, aluminum oxide, clay, diatomaceous earth, kaolin and the like can be incorporated in the thermally developable light-sensitive material of the present invention.

A specific method for preparing the thermally developable light-sensitive material of the present invention is outlined below. That is, an organic silver salt forming agent is reacted with a silver ion supplying agent, for example, silver nitrate, in a variety of known methods to thereby form an organic silver salt. The thus-prepared organic silver salt is, after washing with water or alcohols, etc., dispersed in a binder to produce an emulsion. For dispersion, a colloid mill, a mixer, a ball mill, or the like, can be used. To the thus-prepared polymer dispersion of the silver salt, a silver halide forming agent is added to convert a part of the organic silver salt to silver halide. Alternatively, a silver halide, previously prepared, can be added thereto, and further alternatively, the silver halide can be prepared at the same time the organic silver salt is formed. Then, various additives such as a sensitizing dye, component (d) and component (e) used in the present invention, a reducing agent (c), and the like, are added, in order, preferably in the form of a solution thereof. When all of the additives have been added, a coating composition is prepared. The coating composition is coated onto an appropriate support as it is without drying. Like the thermally developable light-sensitive layer formed using such procedures, the respective coating compositions are prepared for the over coated polymer layer, a subbing layer, a backing layer or other layers, respectively, and are coated, in order, using a variety of coating methods such as an immersion method, an air knife method, a curtain coating method or a hopper coating method to thereby form the above described layers, respectively. Further desired, two or more layers can also be coated simultaneously using the method as described in U.S. Pat. No. 2,761,791 and British Pat. No. 837,095.

If desired, the surface of the back surface of the support or a layer on the support, can be printed with, e.g., fixed patterns, for use as (commuter) tickets for vehicles, post cards or other documents.

The thus-prepared thermally developable light-sensitive material is imagewise exposed to light after being cut into a size suitable for use. If desired the material can be preheated (at about 80° C. to about 140° C.) prior to the exposure to light.

Suitable light sources which can be used for the imagewise exposure include a variety of light sources such as a tungsten lamp, a fluorescent lamp for copying which is mainly used for exposure of diazo light-sensitive materials, a mercury lamp, an iodine lamp, a xenon lamp, a CRT light source, a laser light source, and the like. Originals can not only be line images such as drawings etc., but also can be photographic images with gradation. In addition, it is also possible to take a picture of people or scenery using a camera. Suitable printing techniques include contact printing, reflection printing, or enlargement printing of an original. The amount of exposure will vary depending upon the sensitivity of light-sensitive materials, but, about 10 lux second is suitable for high sensitive materials, and about $10^4$ lux second is suitable for low sensitive materials.

The thus imagewise exposed light-sensitive material can be developed simply by heating (at about 80° to about 180° C., preferably at about 100° to about 150° C.). The heating time is optionally controlled, and can be about 1 second to 60 seconds, etc. The heating time is determined by the heating temperature employed. A variety of heating means can be used. For example, the light-sensitive material may be brought into contact with a simple heated plate. Alternatively, the light-sensitive material may be brought into contact with a heated drum, or, optionally, may also be passed through a heated area. In addition, as described in U.S. Pat. No. 3,811,885, the heating can also be accomplished using high frequency heating or a laser beam. In order to minimize the effect of odors which are emitted upon heating, a deodorant can also be provided in the developing machine. Further, certain perfumes can also be employed so that the odor of the light-sensitive materials is not observed.

The photographic properties of the thermally developable light-sensitive material in accordance with the present invention are not impaired even after storage for a long period of time at high humidity conditions., and the thermally developable light-sensitive material further has the characteristic that a pure black tone image is obtained, which is extremely useful.

The present invention will be explained in greater detail by reference to the following examples.

Unless otherwise indicated herein, all parts, percents, ratios and the like are by weight.

EXAMPLE 1

A mixture of 34 g of behenic acid and 500 ml of water was heated to 85° C. to thereby dissolve the behenic acid. To the mixture of water and behenic acid dissolved at 85° C. and was added an aqueous solution of sodium hydroxide (2.0 g of sodium hydroxide in 50 cc of water) at 25° C. over a period of 3 mins., while stirring at 1800 r.p.m., to form a mixture of sodium behenate and behenic acid. Thereafter, the temperature was reduced from 85° C. to 30° C. while stirring at 1800 r.p.m.

Then, an aqueous solution of silver nitrate (8.5 g of silver nitrate in 50 cc of water) was added thereto (25° C.) over a period of 3 mins. while continuing to stir the mixture. The mixture was stirred for an additional 90 mins. To the mixture was added 200 cc of isoamyl acetate. After the thus-formed silver behenate particles were recovered, the silver behenate particles were dispersed in a solution of polyvinyl butyral in isopropanol (25 g of polyvinyl butyral in 200 cc of isopropanol) using a homogenizer (25° C., 3000 r.p.m., 30 mins.) to prepare a polymer dispersion of silver behenate.

Thereafter the polymer dispersion of silver behenate was kept at 50° C. To the polymer dispersion was added an acetone solution of N-bromosuccinimide (0.7 g of N-bromosuccinimide in 50 cc of acetone) at 25° C. while stirring. The mixture was stirred for an additional 60 mins. to prepare a polymer dispersion of silver bromide and silver behenate.

A portion comprising 1/12 by weight of the thus-obtained dispersion was weighed out, and the temperature of this dispersion (containing 1/240 mol of Ag) was kept at 30° C. While stirring at 200 r.p.m., the components indicated below were added to the polymer dispersion at 5 minute intervals to prepare Coating Compsition (A).

| | | |
|---|---|---|
| (I) | Merocyanine Dye (Sensitizing Dye)* (0.025 wt % methyl Cellosolve solution) | 2 ml |
| (II) | Sodium Benzene Thiosulfonate (0.02 wt % methanol solution | 4 ml |
| (III) | Phthalazinone [Component (d)] (4.5 wt % methyl Cellosolve solution) | 5 ml |
| (IV) | Phthalimide [Component (e)] (4 wt % methyl Cellosolve solution) | 10 ml |
| (V) | o-Bisphenol (reducing agent)** (10 wt % acetone solution) | 10 ml |

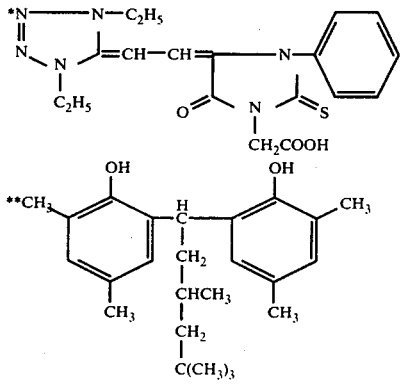

On the other hand, Coating Composition B was prepared for the purpose of comparison in a manner quite similar to the preparation of Coating Composition A except that phthalazinone (III) was not incorporated in the above mentioned composition.

For further comparison, Coating Composition C was prepared in a manner quite similar to the preparation of Coating Composition A except that phthalimide (IV) was not incorporated in the above mentioned composition.

For further comparison, Coating Composition D was prepared in a manner quite similar to the preparation of Coating Composition A except that neither phthalazinone (III) nor phthalimide (IV) was incorporated in the above mentioned composition.

Each of the thus prepared four coating compositions was respectively coated onto a support (a base paper sheet for a pressure sensitive copying subbed with polyvinyl alcohol) in a silver amount of 0.3 g per $m^2$ to thereby prepare Thermally Developable Light-Sensitive Materials (A), (B), (C) and (D), respectively. The thus-prepared Thermally Developable Light-Sensitive Materials (A), (B), (C) and (D) each was exposed to light using a tungsten lamp through an optical wedge (wherein the maximum exposure amount was 3000 CMS). Thereafter, the thermally developable light-sensitive materials were brought into contact with a heating plate at 130° C. for 8 seconds to thereby heat develop the same, respectively.

Separately, Thermally Developable Light-Sensitive Materials (A), (B), (C) and (D) were allowed to stand for 5 days under a relative humidity of 80% and at a temperature of 35° C. (hereafter simply referred to as "forced deterioration").

Thereafter, the thermally developable light-sensitive materials were exposed to light and heat developed under the same conditions as described above.

The reflection density of these samples was measured to determine the photographic properties thereof. The results obtained are shown in Table 1 below.

Table 1

| Sample No. | Presence or Absence of Component (d) | Presence or Absence of Component (e) | Before Forced Deterioration | | | | After Forced Deterioration | | | |
|---|---|---|---|---|---|---|---|---|---|---|
| | | | Fog | $D_{max}$ | Relative Sensitivity* | Color Tone | Fog | $D_{max}$ | Relative Sensitivity* | Color Tone |
| A | Present | Present | 0.11 | 1.39 | 120 | Black | 0.14 | 1.25 | 85 | Balck |
| B | Absent | Present | 0.10 | 0.58 | 35 | Brown | 0.13 | 0.35 | 20 | Yellow |
| C | Present | Absent | 0.12 | 1.39 | 100 | Black-brown | 0.14 | 0.44 | 21 | Brown |
| D | Absent | Absent | 0.03 | 0.03 | — | — | 0.05 | 0.05 | — | — |

*Relative sensitivity when the sensitivity of the Thermally Developable Light-Sensitive Material (C) was made 100. The sensitivity is expressed by the reciprocal of the exposure amount necessary to provide a density of fog +0.1.

It can be seen from the results shown in Table 1 that the Thermally Developable Light-Sensitive Material (A) in accordance with the present invention had less of a decrease in sensitivity and excellent shelf life when subjected to the forced deterioration as compared to Thermally Developable Light-Sensitive Material (C) containing phthalazinone alone as a color toning agent. Thermally Developable Light-Sensitive Material (B) containing phthalimide alone as a color toning agent showed insufficient photographic property prior to the forced deterioration. With Thermally Developable Light-Sensitive Material (D) containing no color toning agent, no image was obtained even before the forced deterioration.

EXAMPLES 2-6

Thermally Developable Light-Sensitive Materials (E), (F), (G), (H) and (I) were prepared in a manner similar to that described in Example 1 except for the following differences. That is, in Coating Composition (A) in Example 1, in place of phthalimide, 4-bromophthalimide, 3-chlorophthalimide, 4-methylphthalimide, sodium salt of phthalimide, and 4-methoxyphthalimide in the amount as shown in Table 2 below, respectively, was employed.

On the other hand, Thermally Developable Light-Sensitive Materials (J), (K), (L), (M) and (N) as shown in Table 2 below were preapred in a manner quite similar to the preparation of Thermally Developable Light-Sensitive Materials (E), (F), (G), (H) and (I), respectively, except that no phthalazinone was incorporated therein.

Table 2

| Example No. | Sample No. | Phthalazinone [Component (d)] | Component (e) |
|---|---|---|---|
| 2 | | | |
| | E | Present | 4-Bromophthalimide |
| | J | Absent | (6 wt % methyl Cellosolve solution) 6 ml |
| 3 | | | |
| | F | Present | 3-Chlorophthalimide |
| | K | Absent | (5 wt % methyl Cellosolve solution) 10 ml |
| 4 | | | |
| | G | Present | 4-Methylphthalimide |
| | L | Absent | (4 wt % methyl Cellosolve solution) 10 ml |
| 5 | | | |
| | H | Present | Sodium salt of phthalimide |
| | M | Absent | (4 wt % methyl Cellosolve solution) 6 ml |
| 6 | | | |
| | I | Present | 4-Methoxyphthalimide |
| | N | Absent | (4 wt % methyl Cellosolve solution) 12 ml |

The above described Thermally Developable Light-Sensitive Materials (E) through (N) and (C) were exposed to light, heat developed and subjected to the forced deterioration testing, and thereafter again exposed to light and heat developed to examine the photographic properties thereof. The results obtained are shown in Table 3.

Table 3

| Example No. | Sample No. | Before Forced Deterioration | | | After Forced Deterioration | | |
|---|---|---|---|---|---|---|---|
| | | Fog | $D_{max}$ | Relative Sensitivity | Fog | $D_{max}$ | Relative Sensitivity |
| 2 | | | | | | | |
| | E | 0.06 | 1.36 | 100 | 0.05 | 1.21 | 80 |
| | J | 0.05 | 0.28 | 21 | 0.05 | 0.11 | — |
| 3 | | | | | | | |

Table 3-continued

| Example No. | Sample No. | Before Forced Deterioration Fog | $D_{max}$ | Relative Sensitivity | After Forced Deterioration Fog | $D_{max}$ | Relative Sensitivity |
|---|---|---|---|---|---|---|---|
| | F | 0.07 | 1.40 | 113 | 0.06 | 1.34 | 90 |
| 4 | K | 0.06 | 0.35 | 25 | 0.06 | 0.18 | — |
| | G | 0.11 | 1.38 | 115 | 0.14 | 1.28 | 85 |
| 5 | L | 0.11 | 0.45 | 28 | 0.13 | 0.26 | 13 |
| | H | 0.13 | 1.41 | 128 | 0.19 | 1.31 | 115 |
| 6 | M | 0.14 | 0.63 | 40 | 0.18 | 0.45 | 19 |
| | I | 0.11 | 1.39 | 108 | 0.13 | 1.18 | 83 |
| 1 | N | 0.10 | 0.43 | 25 | 0.14 | 0.22 | 11 |
| | C | 0.12 | 1.39 | 100 | 0.14 | 0.44 | 21 |

It can be seen from Table 2 and Table 3 above that Thermally Developable Light-Sensitive Materials (E), (F), (G), (H) and (I) in accordance with the present invention had less of a decrease in sensitivity due to the forced deterioration and also had excellent shelf life when compared with Thermally Developable Light-Sensitive Material (C) containing phthalazinone alone as a color toning agent. In addition, Thermally Developable Light-Sensitive Materials (E), (F), (G), (H) and (I) in accordance with the present invention provided pure black images which were not affected by the forced deterioration. With Thermally Developable Light-Sensitive Material (J), (K), (L), (M) or (N) containing phthalimide alone as a color toning agent, the photographic properties thereof were insufficient before the forced deterioration, and, in addition, the color tone of the image obtained was yellow brown to yellow, which was insufficient. It was also found that Thermally Developable Light-Sensitive Material (E) and (F) using phthalimides with a halogen atom as a substituent possessed less fog.

EXAMPLES 7–8

Thermally Developable Light-Sensitive Materials (O) and (P) were prepared, respectively, in a manner similar to Example 1 except for the following differences. That is, in Coating Composition (A) of Example 1, in place of phthalazinone (III), 4-hydroxymethylphthalazinone or 4-methylphthalazinone, in the amount as shown in Table 4 below, was used.

On the other hand, Thermally Developable Light-Sensitive Materials (Q) and (R) were prepared in a manner similar to the preparation of Thermally Developable Light-Sensitive Materials (O) and (P) except that no phthalimide was incorporated therein.

The above described Thermally Developable Light-Sensitive Materials (O) through (R) and (C) were exposed to light and heat developed and subjected to the forced deterioration, and thereafter again exposed to light and heat developed, as in Example 1, to examine the photographic properties. The results obtained are shown in Table 5 below.

Table 4

| Example No. | Sample No. | Component (d) | | Phthalimide [Component (e)] |
|---|---|---|---|---|
| 7 | | | | |
| | O | 4-Hydroxymethylphthalazinone | | Present |
| | Q | (3 wt % methyl Cellosolve | | Absent |
| | | solution) | 9 ml | |
| 8 | | | | |
| | P | 4-Methylphthalazinone | | Present |
| | R | (3 wt % methyl Cellosolve | | Absent |
| | | solution) | 7 ml | |

Table 5

| Example No. | Sample No. | Before Forced Deterioration Fog | $D_{max}$ | Relative Sensitivity | After Forced Deterioration Fog | $D_{max}$ | Relative Sensitivity |
|---|---|---|---|---|---|---|---|
| 7 | | | | | | | |
| | O | 0.12 | 1.39 | 108 | 0.15 | 1.15 | 75 |
| | Q | 0.11 | 0.55 | 68 | 0.12 | 0.23 | 16 |
| 8 | | | | | | | |
| | P | 0.11 | 1.18 | 95 | 0.11 | 1.04 | 65 |
| | R | 0.12 | 0.18 | — | 0.12 | 0.17 | — |
| 1 | | | | | | | |
| | C | 0.12 | 1.39 | 100 | 0.14 | 0.44 | 21 |

It can be seen from the results shown in Table 5 that Thermally Developable Light-Sensitive Materials (O) and (P) in accordance with the present invention had less of a decrease in sensitivity due to the forced deterioration and had excellent shelf life when compared with Thermally Developable Light-Sensitive Materials (Q), (R) and (C), none of which contained phthalimide. In addition, Thermally Developable Light-Sensitive Materials (O) and (P) in accordance with the present invention provides pure black images and this color tone was produced constantly even after the forced deterioration.

Thermally Developable Light-Sensitive Materials (Q) and (R) which contained as a color toning agent 4-hydroxymethylphthalazinone alone or 4-methylphthalazinone alone therein had insufficient photographic properties before the forced deterioration and the color tone of the images obtained thereby also changed from black-brown (before the forced deterioration) to brown (after the forced deterioration).

While the invention has been described in detail and with reference to specific embodiments thereof, it will be apparent to one skilled in the art that various changes and modifications can be made therein without departing from the spirit and scope thereof.

What is claimed is:

1. In a thermally developable light-sensitive material containing at least (a) an organic silver salt;

(b) a photocatalyst, and (c) a reducing agent in a support and/or in one or more layers thereon, the improvement which comprises said thermally developable light-sensitive material additionally containing (d) at least one phthalazinone and (e) at least one phthalimide in said one or more layers, in an over coated layer on said one or more layers, in a subbing layer between the support and said one or more layers and/or in said support said phthalimide being represented by the general formula (II):

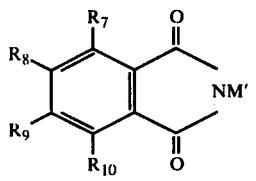

(II)

wherein $R_7$, $R_8$, $R_9$ and $R_{10}$ each represents a hydrogen atom, a halogen atom, a hydroxy group, a nitro group, an amino group and a carbon-containing substituent having 1 to 20 carbon atoms which may further contain an oxygen atom, a nitrogen atom, a sulfur atom, or a halogen atom but at least one of $R_7$, $R_8$, $R_9$ or $R_{10}$ represents a halogen atom; and $R_7$ and $R_8$, $R_8$ and $R_9$, and $R_9$ and $R_{10}$, each when combined together, may form an aromatic ring; and M' represents a hydrogen atom or a monovalent metal atom but at least one of $R_7$, $R_8$, $R_9$ and $R_{10}$ is a halogen atom.

2. The thermally developable light-sensitive material as claimed in claim 1, wherein said phthalazinone is represented by the general formula (I):

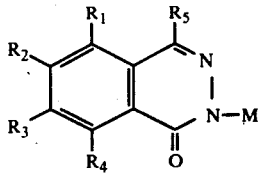

(I)

wherein $R_1$, $R_2$, $R_3$, $R_4$ and $R_5$, which may be the same or different, each represents a hydrogen atom, a halogen atom, a hydroxy group, a nitro group, an amino group, or a carbon-containing substituent having 1 to 20 carbon atoms which may also contain an oxygen atom, a nitrogen atom, a sulfur atom, and a halogen atom; and M represents a hydrogen atom, a monovalent metal atom, a hydroxyalkyl group having 1 to 5 carbon atoms, and a carbamoyl group containing a carbon-containing substituent having 1 to 18 carbon atoms which may further contain an oxygen atom, a sulfur atom, a nitrogen atom or a halogen atom.

3. The thermally developable light-sensitive material as claimed in claim 2, wherein said carbon-containing substituent for $R_1$ to $R_5$ is an alkyl group having 1 to 4 carbon atoms, a cycloalkyl group having 5 to 6 carbon atoms, a haloalkyl having 1 to 4 carbon atoms, a hydroxyalkyl group having 1 to 4 carbon atoms, an alkoxy group having 1 to 4 carbon atoms, an aryl group which may be substituted with an alkyl group having 1 to 4 carbon atoms or a halogen atom, an aralkyl group having 7 to 12 carbon atoms, an acyl group having 2 to 4 carbon atoms, an alkenyl group having 3 to 6 carbon atoms, an alkyl group having 1 to 4 carbon atoms and which is substituted with a morpholino group, a 2-substituted vinyl group, an aminoalkyl group having 1 to 4 carbon atoms, an aminoalkyl group having 1 to 4 carbon atoms and which may further substituted with an alkyl group having 1 to 4 carbon atoms, or an amino group which is substituted with an alkyl group having 1 to 4 carbon atoms.

4. The thermally developable light-sensitive material as claimed in claim 1, wherein said carbon-containing substituent for $R_7$ to $R_{10}$ is an alkyl group having 1 to 6 carbon atoms, a haloalkyl group having 1 to 6 carbon atoms, a hydroxyalkyl group having 1 to 6 carbon atoms, an alkoxy group having 1 to 6 carbon atoms, an aralkoxy group having 7 to 12 carbon atoms, a cycloalkyl group having 5 to 12 carbon atoms, a cycloalkoxy group having 5 to 12 carbon atoms, an amino group which is substituted with an alkyl group having 1 to 4 carbon atoms, an acyl group having 2 to 6 carbon atoms, an alkenyl group having 3 to 6 carbon atoms, an aryl group which may be substituted with an alkyl group having 1 to 6 carbon atoms or a halogen atom, or an aralkyl group having 7 to 12 carbon atoms.

5. The thermally developable light-sensitive material as claimed in claim 1, wherein said component (d) is present in an amount of about 0.1 mol to about 2 mols per mol of said organic silver salt (a).

6. The thermally developable light-sensitive material is claimed in claim 1, wherein said component (e) is present in an amount of about 0.1 mol to about 4 mols per mol of said component (d).

7. A process for producing an image which comprises imagewise exposing the thermally developable light-sensitive material as claimed in claim 1 to light and then heating the exposed light-sensitive material to temperatures of about 80° to about 180° C.

8. The thermally developable light-sensitive material as claimed in claim 2, wherein $R_1$, $R_2$, $R_3$ and $R_4$ are hydrogen atoms.

* * * * *